US006491492B1

(12) United States Patent
Cook

(10) Patent No.: US 6,491,492 B1
(45) Date of Patent: Dec. 10, 2002

(54) BATCH SHEET FEEDER

(75) Inventor: Edward J. Cook, Toronto (CA)

(73) Assignee: Longford Equipment International Limited, Scarborough (CA)

( * ) Notice: Subject to any disclaimer, the term of this patent is extended or adjusted under 35 U.S.C. 154(b) by 0 days.

(21) Appl. No.: 09/684,214

(22) Filed: Oct. 6, 2000

(51) Int. Cl.[7] ..... B65H 31/30

(52) U.S. Cl. ..... 414/789.9; 414/794.4; 271/202; 271/213; 271/221; 271/176

(58) Field of Search ..... 414/789.9, 794.4, 414/794.8; 271/276, 182, 198, 202, 272, 207, 213, 221, 149, 3.01, 3.08, 3.09, 3.13, 4.06, 4.57, 7, 176

(56) References Cited

U.S. PATENT DOCUMENTS

| | | | | | |
|---|---|---|---|---|---|
| 2,852,256 | A | | 9/1958 | Faulls, Jr. et al. | 271/76 |
| 3,178,174 | A | * | 4/1965 | Schneider | 271/202 |
| 3,231,100 | A | | 1/1966 | Faeber | |
| 3,370,848 | A | * | 2/1968 | Bartlett | 271/221 |
| 3,749,398 | A | | 7/1973 | Fujita et al. | 271/86 |
| 3,756,591 | A | | 9/1973 | Müller | 271/69 |
| 4,200,276 | A | | 4/1980 | Marschke | 271/279 |
| 4,354,787 | A | * | 10/1982 | Gersike et al. | 271/213 |
| 4,436,302 | A | * | 3/1984 | Frye et al. | 271/202 |
| 4,651,983 | A | | 3/1987 | Long | 271/35 |
| 4,750,729 | A | * | 6/1988 | Kdnoto et al. | 414/789.9 |
| 4,805,890 | A | * | 2/1989 | Martin | 414/794.4 |
| 5,282,614 | A | * | 2/1994 | Kalisiak et al. | 271/270 |
| 5,431,387 | A | | 7/1995 | Loben et al. | 271/213 |
| 5,431,530 | A | * | 7/1995 | Kobayashi et al. | 414/794.9 |
| 5,613,673 | A | | 3/1997 | Roberts et al. | 271/182 |

FOREIGN PATENT DOCUMENTS

| | | | | |
|---|---|---|---|---|
| EP | 0150655 | * | 8/1985 | 271/182 |
| WO | WO 99/67162 | | 12/1999 | |

* cited by examiner

*Primary Examiner*—H. Grant Skaggs
(74) *Attorney, Agent, or Firm*—David P. Gordon; David S. Jacobson; Thomas A. Gallagher

(57) ABSTRACT

A shingling nip roll is added between an infeed conveyor and a reciprocating table. The nip roll slows the speed of the sheets thereby reducing bruising and buckling as sheets are ejected to the table. Further, the trailing end of a dropped sheet is overlapped by a leading end of the next upstream sheet which assists in maintaining control of the dropped sheet as it drops onto the reciprocating table.

21 Claims, 3 Drawing Sheets

BATCH SHEET FEEDER

BACKGROUND OF THE INVENTION

This invention relates to an apparatus and method for batch feeding sheets.

A high speed method of batch feeding sheets is to serially feed the sheets onto a table until the desired batch size has been accumulated, whereupon the table is rapidly retracted to drop the batch onto a downstream stack handler. The table is then rapidly extended again so that the process may be repeated. Such a table may be referred to as a reciprocating table. This type of batch feeding apparatus may have endless belt conveyors which sandwich the sheets and eject them toward the reciprocating table. A difficulty with this arrangement is that if the sheets are large and thin, they tend to buckle when ejected by the belt feeders and may cause jams. Furthermore, the front of some paper stock sheets are bruised when they impact the table or a front stop for the table. Also, feeding at high speed tends to cause small transverse misalignments in the sheets which stack at the table. It is difficult to steer sheets at high speeds in order to avoid such misalignments without causing buckling.

This invention seeks to overcome drawbacks of known reciprocating table batch feeders.

SUMMARY OF THE INVENTION

The subject invention places a shingling nip roll between an infeed conveyor and the reciprocating table. The nip roll slows the speed of the sheets thereby reducing bruising and buckling. Further, the trailing end of a dropped sheet is overlapped by a leading end of the next upstream sheet which assists in maintaining control of the dropped sheet as it drops onto the reciprocating table.

Accordingly, the present invention provides a batch sheet feeder, comprising: a sheet feeding conveyor operating at a first speed; a shingling nip roll spaced downstream of a downstream end of said sheet feeding conveyor, said nip roll operating at a second speed slower than said first speed; a sheet support extending between said downstream end of said sheet feeding conveyor and said nip roll; a horizontally reciprocating table downstream and below said nip roll.

In accordance with another aspect of the present invention, there is provided a batch feeding method comprising: feeding sheets travelling at a first speed through a nip roll travelling at a slower second speed such that said sheets are shingled; at a drop station, serially dropping sheets from said shingled sheets downwardly onto a reciprocating table such that a tail end of a dropped sheet is partially controlled by an overlapping leading end of a next upstream sheet.

BRIEF DESCRIPTION OF THE DRAWINGS

In the figures which disclose example embodiments of the invention.

DETAILED DESCRIPTION OF EXAMPLE EMBODIMENTS

Figure 1:
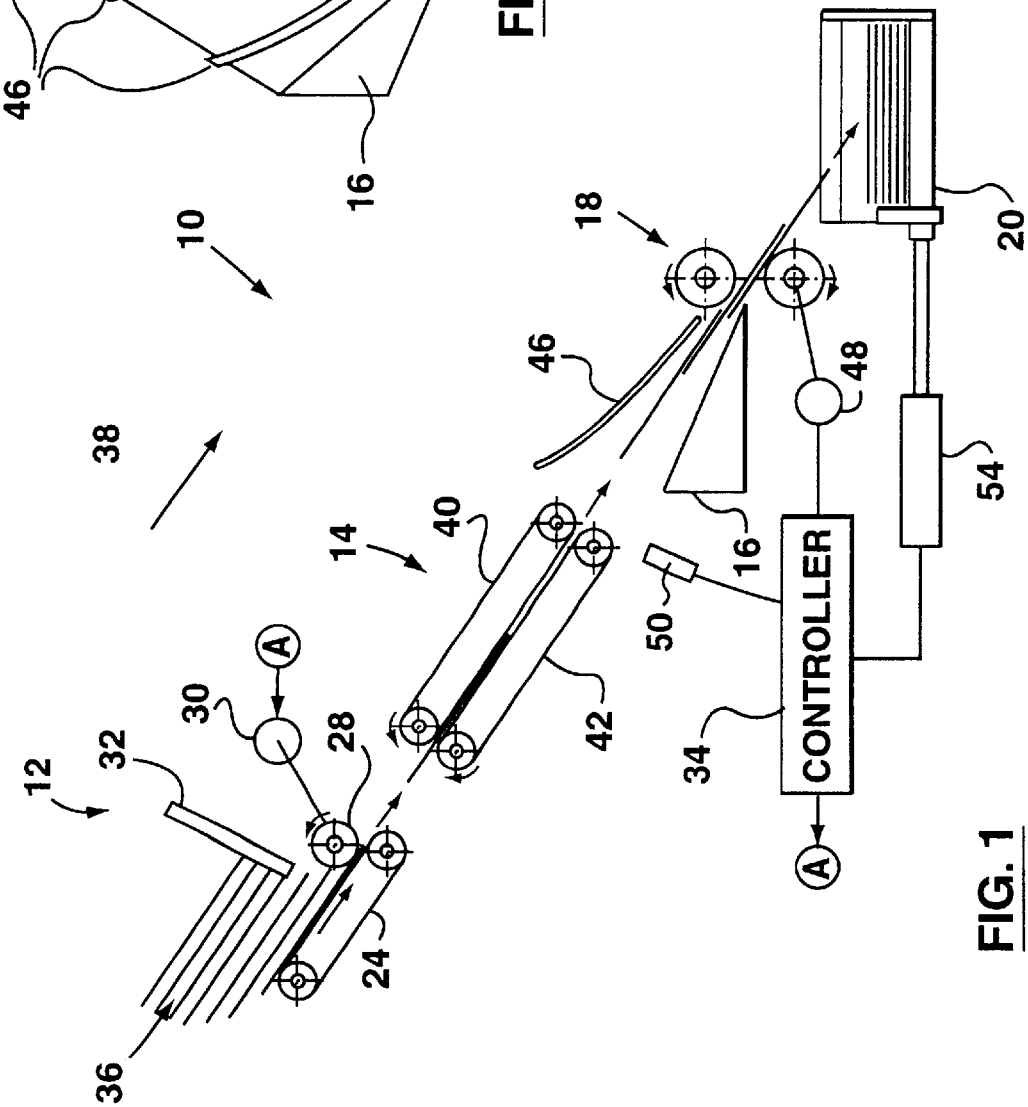
FIG. 1 is a schematic side view of a first embodiment of the invention.

Referencing FIG. 1, a batch sheet feeder 10 comprises, in downstream order, a pulsed sheet feeder 12, a sheet feeding conveyor 14, a sheet support 16, nip rollers 18, and a reciprocating table 20.

The pulsed sheet feeder 12 comprises a belt conveyor 24, a pulsed feed wheel 28 which forms a nip with the belt conveyor 24, a drive 30 for the pulsed feed wheel, and a sheet stack guide 32. Drive 30 receives an input from controller 34. In operation, a sheet stack 36 rests on belt conveyor 24 and against guides 32. A drive (not shown) continuously rotates conveyor 24. Pulsed feed wheel 28 rotates through an arc whenever its drive 32 receives a control signal from controller 34 to feed a single sheet from the bottom of sheet stack 36 in a downstream direction 38. A suitable pulsed sheet feeder 12 is further described in U.S. Pat. No. 4,651,983 to Long, the contents of which are incorporated by reference herein.

The sheet feeding conveyor 14 comprises an upper set of parallel endless bands 40 and a lower set of endless parallel bands 42 which, together, sandwich sheets passing therebetween. A drive (not shown) is provided to continuously drive the sheet feeding conveyor 14 to feed sheets in the downstream direction 38 at a high speed.

Figure 2:
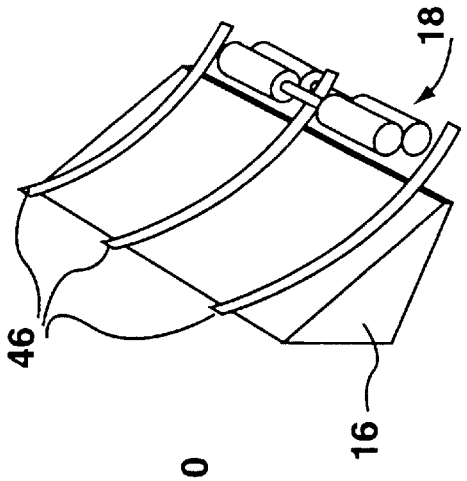
FIG. 2 is a perspective view of a portion of FIG. 1.

Referencing FIG. 2 along with FIG. 1, the sheet support 16 is a wedge having a sheet supporting upper surface on which sheets ejected from the sheet feeding conveyor 14 ride. Sheet guides 46, which may be plastic strips, have an upstream end supported above the sheet support 16 and a downstream portion which rests on the sheet support. The sheet guides 46 may extend downstream of the downstream end of the sheet support 16.

The pair of nip rollers 18 is positioned immediately downstream of the sheet support 16; the nip rollers are driven at a slower speed than sheet feed conveyor 14 by drive 48 under to control of controller 34. The upper nip roll is spring loaded so as to accommodate different thicknesses through the nip. Controller 34 receives an input from sheet sensor 50.

Figure 3:
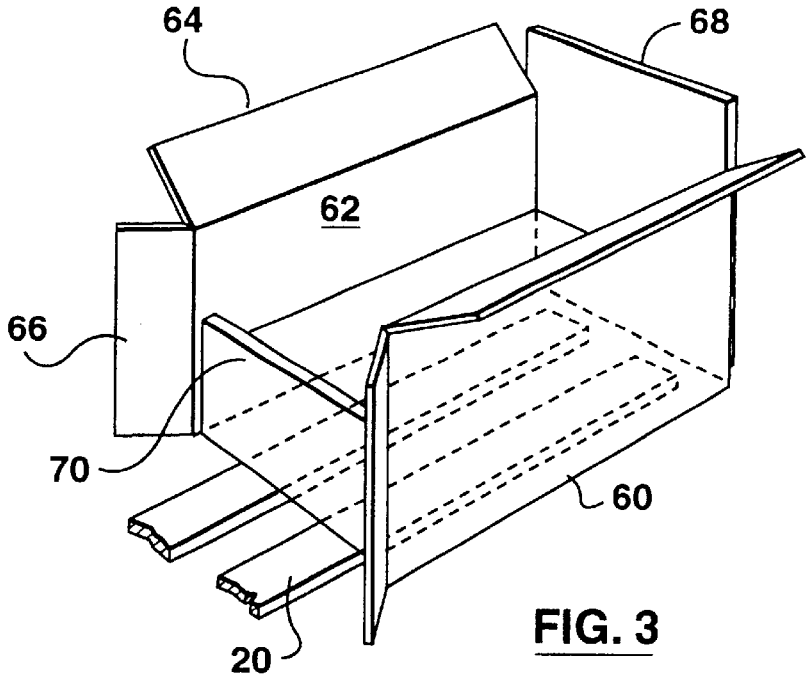
FIG. 3 is a perspective view of another portion of FIG. 1.
Figure 4:
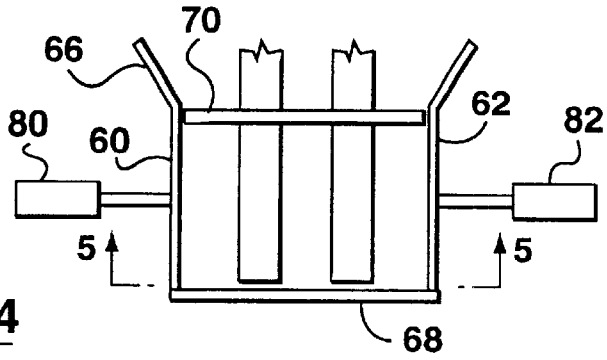
FIG. 4 is a top view of FIG. 3 showing optional tampers.
Figure 5:
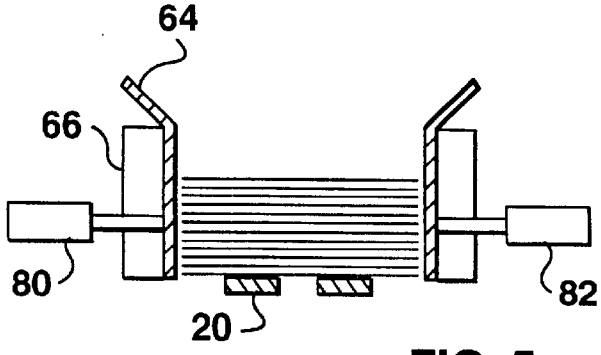
FIG. 5 is a cross-sectional view along the lines 5—5 of FIG. 4.

The reciprocating table 20 is reciprocated by a piston 54 which receives a control input from controller 34. As illustrated in FIGS. 3 to 5, a pair of side walls 60, 62 extend upwardly from the reciprocating table 20. The top 64 of these side walls is funnel-shaped, as is the upstream end 66 of the side walls. A downstream front stop 68 and an upstream stripper wall 70 extend between the side walls. As shown in FIGS. 4 and 5, each side wall 60, 62 is mounted to a tamper 80, 82. A suitable reciprocating table, albeit one operating under control of a motor and cam rather than under control of a piston, is described in U.S. Pat. No. 5,431,387 to Loben, the contents of which are incorporated by reference herein.

In operation, controller 34 may pulse pulsed feed wheel 28 to serially feed sheets from the bottom of stack 36. A sheet fed from the stack is entrained by high speed sheet feeding conveyor 14 and ejected at the downstream end of the sheet feeding, conveyor to sheet support 16. As the sheet moves along the sheet support, the guides 46 assist in guiding the sheet into the nip of nip rollers 18. Nip rolls 18 are operated at a slower speed than that of sheet feeding conveyor 14 such that sheets are shingled at the nip rolls with upstream sheets overlapping. downstream sheets. In an example embodiment, the nip rolls may operate at one-quarter the speed of the sheet feeding conveyor 14. Sheets feed from the nip rollers 18 to reciprocating table 20. The funnelling top 64 and front 66 edges of side walls 60, 62 associated with the table assist in creating a stack of sheets which is registered side-to-side as sheets drop onto table 20. The side walls may also be intermittently tamped by tampers 80, 82 to further jog the sheets of the stack forming on table 20 into side-to-side registration. The front edge of the sheets are typically registered in the stack by virtue of stopping against front wall 68. Nevertheless, due to the relatively slow speed with which the sheets are ejected from the nip rolls, bruising of the sheets as they hit the front stop is very unlikely. As a sheet is ejected from the nip between rolls 18 and drops toward table 20, the next adjacent upstream sheet, which is in overlapping relation with the ejected sheet, assists in controlling the trailing edge of the ejected sheet. In other words, the trailing edge of the ejected sheet is not free to flap upwardly, but only to move along the bottom surface of the overlapping sheet and/or downwardly.

Based on input from sheet sensor 50, the controller can count the number of sheets which are fed to table 20. When this number reaches a pre-defined batch number, the controller signals piston 54 causing reciprocating table 20 to temporarily retract. When the table retracts, the stack on the table is stripped from the table by rear stripper wall 70 and follows to a downstream stack handler (not shown). The table then immediately extends again to be ready to receive a further stack. If necessary, the controller can pause the nip rollers 18 and sheet feeder 12 to give time for the table to reciprocate.

If the controller senses an overlong gap between sheets exiting sheet feeding conveyor 14 (such as may be the result of a misfeed at sheet feeder 12), the controller may pause the nip rollers 18. This prevents the possibility of a sheet feeding almost completely through nip 18 before another sheet arrives at the nip: in such an eventuality, the upstream sheet could hit the end of the downstream sheet rather than overlapping it.

Figure 6:
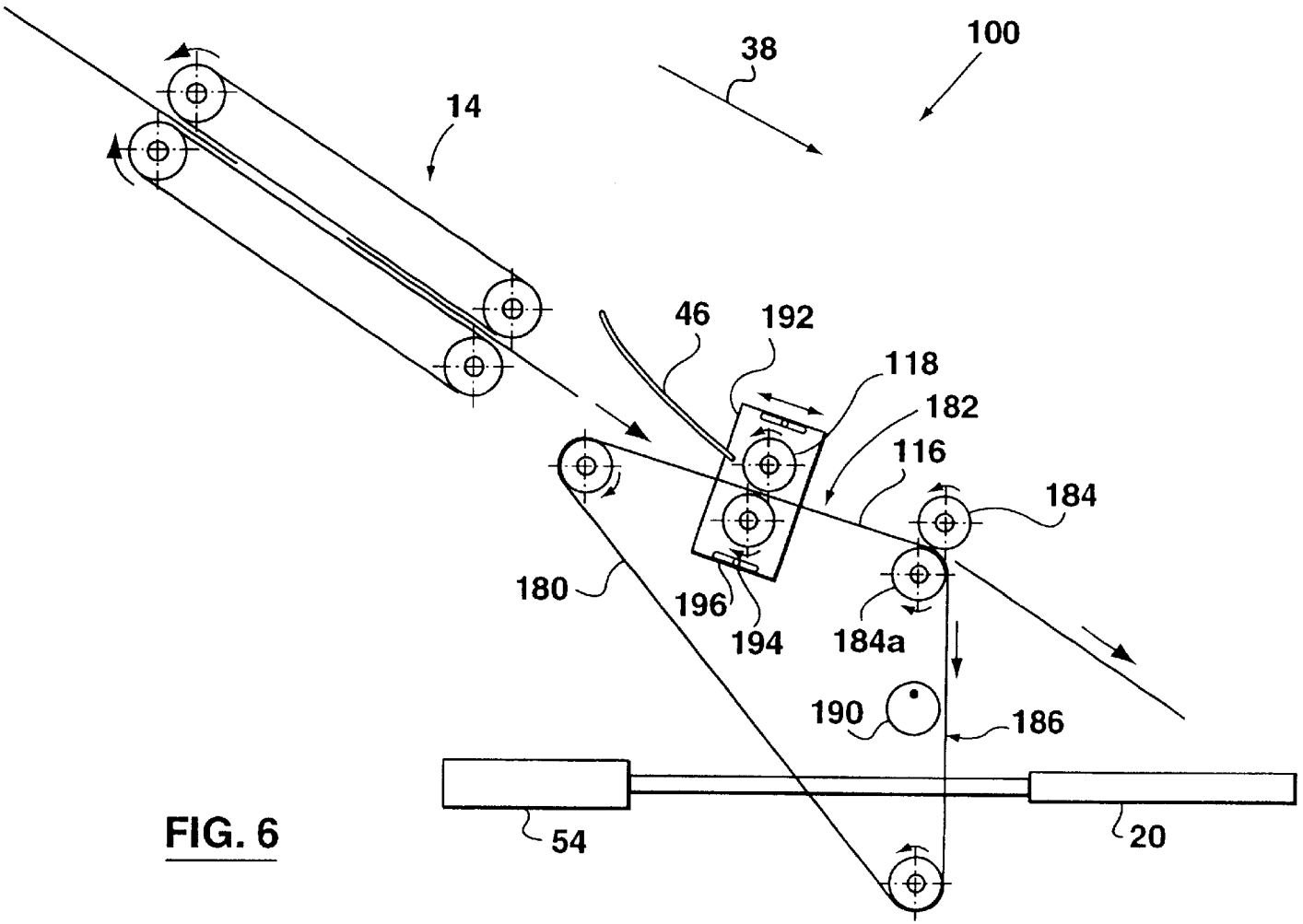
FIG. 6 is a schematic side view of a second embodiment of the invention.

It is preferable that the distance between the downstream end of the sheet feeding conveyor 14 and the nip rolls 18 be approximately equal to the length of a sheet. To adapt the feeder to accommodate sheets of different lengths, the embodiment of the feeder shown in FIG. 6 may be employed. Turning to FIG. 6, wherein like numerals have been given like numbers, batch feeder 100 has a triangular endless belt 180 with an upper run 182 having a sheet supporting surface 116. Upper run 182 extends both upstream and downstream of the nip rolls 18, passing through their nip. The endless belt 180 extends around the lower roll 184*a* of a second pair of nip rolls 184 and has a vertical run 186 from roll 184*a* to below table 20. An eccentric cam 190 rotates to intermittently jog the vertical run 186 of endless belt 180. A drive (not shown) drives belt 180 such that its upper run 182 moves in downstream direction 38.

Nip rolls 18 are mounted on carriage 192. The carriage 192 is mounted to a frame (not shown) by virtue of bolts 194 which thread through slots 196.

The operation of the batch feeder 100 is identical to that of feeder 10, except as follows. By virtue of the slots 196 of carriage 192, the downstream position of nip rolls 18 may be adjusted (within limits defined by the bolts reaching the end of the slots). In consequence, feeder 100 may be used with sheets of different lengths merely by adjusting the downstream position of nip rolls 18 so that are spaced from sheet feeder 14 by an amount approximately equal to the length of the sheets. As before, nip rolls 18 shingle the sheets. Because of the adjustable position of nip rolls 18, they cannot be fixed at a position for proper feeding to table 20. In consequence, nip rolls 184 are provided. Shingled sheets leaving nip rolls 18 pass to nip rolls 184 where they are ejected to table 20.

The vertical run 186 of endless belt 186, which is proximate the rear edge of a stack of sheets on table 20, assists in moving the trailing edge of ejected sheets downwardly onto the table 20.

Eccentric cam 190 may rotate to jog run 186 in a downstream direction in order to assist in ensuring the sheets stacked on table 20 are registered front to back.

Other modifications will be apparent to those skilled in the art and, therefore, the invention is defined in the claims.

What is claimed is:

1. A batch sheet feeder, comprising:

a sheet feeding conveyor operating at a first speed;

a shingling nip roll spaced downstream of a downstream end of said sheet feeding conveyor, said nip roll operating at a second speed slower than said first speed;

a sheet support extending between said downstream end of said sheet feeding conveyor and said nip roll;

a horizontally reciprocating table downstream and below said nip roll;

a sheet sensor; and a controller responsive to said sheet sensor for counting sheets and for reciprocating said horizontally reciprocating table when a desired batch of sheets has been counted.

2. The feeder of claim 1 further comprising a lead in guide having an upstream end above said sheet support and a downstream portion resting on said sheet support.

3. The feeder of claim 2 wherein said guide extends downstream of said nip roll.

4. The feeder of claim 3 wherein said nip roll comprises a first nip roll and further comprising a second nip roll below said first nip roll and forming a nip therewith.

5. The feeder of claim 1 including a tamper for tamping sheets stacked on said reciprocating table.

6. The feeder of claim 1 wherein said sheet support comprises a conveyor.

7. The feeder of claim 6 wherein said sheet support conveyor extends both upstream and downstream of said nip roll.

8. The feeder of claim 7 wherein said sheet support conveyor has a substantially vertical run feeding downwardly toward said reciprocating table and positioned proximate an upstream end of said reciprocating table for urging trailing end of sheets downwardly onto said reciprocating table.

9. The feeder of claim 1 wherein said controller is also for pausing said shingling nip roll while reciprocating said table.

10. A sheet feeder comprising:

a sheet feeding conveyor operating at a first speed, a shingling nip roll spaced downstream of a downstream end of said sheet feeding conveyor, said nip roll operating at a second speed slower than said first speed;

a sheet support extending between said downstream end of said sheet feeding conveyor and said nip roll;

a horizontally reciprocating table downstream and below said nip roll;

a pair of side walls extending upwardly from said reciprocating table, said side walls defining a funnel-shaped top portion and a funnel-shaped upstream end portion for funnelling sheets onto said table in a stack.

11. The feeder of claim 10 further comprising:

a back stop wall at a downstream end of said side walls.

12. The feeder of claim 10 wherein said sheet support comprises a stationary surface.

13. The feeder of claim 10 further comprising a sheet sensor upstream of said nip roll and a controller for sensing an overlong feed gap in sheets fed by said conveyor and for temporarily stopping said nip roll in response.

14. The feeder of claim 10 including a tamper for tamping sheets stacked on said reciprocating table.

15. A feeder, comprising:

a sheet feeding conveyor operating at a first speed;

a shingling nip roll spaced downstream of a downstream end of said sheet feeding conveyor, said nip roll operating at a second speed slower than said first speed;

a sheet support extending between said downstream end of said sheet feeding conveyor and said nip roll;

a horizontally reciprocating table downstream and below said nip roll;

a travelling belt having a substantially vertical run extending between two spaced supports, said vertical run feeding downwardly toward said reciprocating table and positioned proximate an upstream end of said reciprocating table for urging ailing end of sheets downwardly onto said reciprocating table.

16. The feeder of claim 15 including an eccentric roll for acting against said vertical run of said sheet support conveyor in order to intermittently jog said vertical run of said sheet support conveyor in a generally downstream direction whereby to tamp a trailing end of sheets stacked on said reciprocating table.

17. A feeder, comprising:

a sheet feeding conveyor operating at a first speed;

a shingling nip roll spaced downstream of a downstream end of said sheet feeding conveyor, said nip roll operating at a second speed slower than said first speed;

a sheet support extending between said downstream end of said sheet feeding conveyor and said nip roll;

a horizontally reciprocating table downstream and below said nip roll;

a travelling belt having a substantially vertical run feeding downwardly toward said reciprocating table and positioned proximate an upstream end of said reciprocating table for urging trailing end of sheets downwardly onto said reciprocating table;

an eccentric roll for acting against said vertical run of said travelling belt in order to intermittently jog said vertical run of said belt in a generally downstream direction whereby to tamp a trailing end of sheets stacked on said reciprocating table.

18. A feeder comprising a sheet feeding conveyor operating at a first speed;

a shingling nip roll spaced downstream of a downstream end of said sheet feeding conveyor, said nip roll operating at a second speed slower than said first speed;

a sheet support extending between said downstream end of said sheet feeding conveyor and said nip roll;

a horizontally reciprocating table downstream and below said nip roll;

a lockable slide mount for said nip roll such that a downstream position of said nip roll my be adjusted.

19. The feeder of claim 18 wherein said nip roll is an upstream nip roll and further comprising a downstream nip roll between said upstream nip roll and said reciprocating table, said downstream nip roll operating at said second speed.

20. The feeder of claim 19 wherein said downstream nip roll is one of a pair of co-operating nip rolls and wherein said sheet conveyor extends around a lower one of said co-operating nip rolls at the top of said vertical run.

21. The feeder of claim 18 including a tamper for tamping sheets stacked on said reciprocating table.

* * * * *